US007441871B2

(12) United States Patent
Nishijima

(10) Patent No.: US 7,441,871 B2
(45) Date of Patent: Oct. 28, 2008

(54) LIQUID-REPELLENT MEMBER, NOZZLE PLATE, LIQUID-JET HEAD USING THE SAME, AND LIQUID-JET APPARATUS

(75) Inventor: Tatsumi Nishijima, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 429 days.

(21) Appl. No.: 11/401,921

(22) Filed: Apr. 12, 2006

(65) Prior Publication Data

US 2006/0244770 A1 Nov. 2, 2006

(30) Foreign Application Priority Data

Apr. 12, 2005 (JP) ..... 2005-115021

(51) Int. Cl.
*B41J 2/14* (2006.01)
*B41J 2/135* (2006.01)

(52) U.S. Cl. ..... 347/47; 347/45

(58) Field of Classification Search ..... 347/45, 347/47

See application file for complete search history.

(56) References Cited

U.S. PATENT DOCUMENTS 6,923,525 B2 * 8/2005 Miyakawa et al. ..... 347/45
2002/0022139 A1 2/2002 Kotera et al.
2004/0101645 A1 5/2004 Sunada et al.
2004/0125169 A1 7/2004 Nakagawa et al.

FOREIGN PATENT DOCUMENTS

EP 1 475 234 A1 11/2004
JP 5-116309 A 5/1993
JP 5-116324 A 5/1993
JP 2004-351923 A 12/2004

OTHER PUBLICATIONS

European Search Report dated Aug. 22, 2006.

* cited by examiner

*Primary Examiner*—An H Do
(74) *Attorney, Agent, or Firm*—Sughrue Mion, PLLC

(57) ABSTRACT

To provide a liquid-repellent member such as a nozzle plate having high liquid repellency and liquid-repellent durability, a liquid-jet head using the same, and a liquid-jet apparatus.

A liquid-repellent member includes: an underlayer film which is provided on a surface of a base and contains silicon; and a liquid-repellent film which is provided on the underlayer film and is made of a silane coupling agent having a fluorocarbon group. In the liquid-repellent member, a intensity ratio of ions highest detected in fluorocarbon-based fragment ions to silicon ions is greater than or equal to 10 when the fluorocarbon-based fragment ions and the silicon ions are detected through measurement by a Time-of-Flight Secondary Ion Mass Spectrometer.

7 Claims, 7 Drawing Sheets

LIQUID-REPELLENT MEMBER, NOZZLE PLATE, LIQUID-JET HEAD USING THE SAME, AND LIQUID-JET APPARATUS

The entire disclosure of Japanese Patent Application No. 2005-115021 filed Apr. 12, 2005 is expressly incorporated by reference herein.

BACKGROUND OF THE INVENTION

1. Field of the Invention

The present invention relates to a liquid-repellent member, a liquid-jet head using the same, and a liquid-jet apparatus.

2. Description of the Related Art

A liquid-jet head has a nozzle plate in which a large number of fine eject holes (nozzle orifices) for ejecting a liquid therefrom are formed at minute spaced intervals. When ejected from the eject holes, ink may adhere to an ejecting surface. In this case, when ink next ejected comes into contact with adhered ink remaining on the ejecting surface, an ejecting path for the next ink droplets ejected is curved under influence of surface tension, viscosity or other properties of the adhered ink. Thus, the adhered ink remaining on the ejecting surface causes a problem of making it impossible to perform printing in a predetermined spot. Techniques for solving this problem include a technique of providing a liquid-repellent film on the jet surface of the nozzle plate for a purpose of preventing adhered ink from remaining on the ejecting surface (see Japanese Patent Laid-open Official Gazette No. 2004-351923).

When the liquid-repellent film is provided on a solid surface such as the nozzle plate, a contact angle of a liquid (usually water) is generally, taken as an index of liquid repellency of the solid surface. Moreover, high alkali resistance is required for long-term use because ink is often alkaline. Evaluation of durability of the liquid repellency (hereinafter referred to as "liquid-repellent durability") involves, for a long period of time, dripping a liquid onto the solid surface, exposing the liquid thereon, or subjecting the solid surface to mechanical friction; measuring the contact angle; and evaluating the liquid-repellent durability according to whether the measured value is high or low (see "The latest trends in high-water-repellent techniques from the ultra-water-repellent materials to the latest applications thereof," TORAY Research Center, Inc., Oct. 1, 2001, pp. 20-21, for example).

However, the contact angle does not indicate only the liquid repellency of the solid surface, because the contact angle varies according to not only the liquid repellency but also interaction among characteristics of a liquid such as a type, concentration or temperature thereof, and a state of the solid surface such as chemical factors or physical structural factors of its topmost surface. Moreover, even if the contact angle is changed by contamination on the solid surface, when a level of the contamination is a trace and invisible, the contact angle value may be misinterpreted. Therefore, there is a case where the liquid repellency or liquid-repellent durability may be often low although the result of evaluation based on the contact angle shows that the liquid repellency or liquid-repellent durability is good. It has been difficult to stably supply a member having excellent liquid repellency and liquid-repellent durability.

SUMMARY OF THE INVENTION

Taking into consideration the aforementioned problems, an object of the present invention is to provide a liquid-repellent member such as a nozzle plate having high liquid repellency and liquid-repellent durability, a liquid-jet head using the same, and a liquid-jet apparatus.

As a result of a tremendous research effort, the inventors have brought the present invention to completion by finding out that a intensity ratio of specific ions detected by a Time-of-Flight Secondary Ion Mass Spectrometer (ToF-SIMS) can serve as an index of liquid repellency and liquid-repellent durability of a liquid-repellent member.

In a first aspect of the present invention, a liquid-repellent member includes: an underlayer which is provided on a surface of a base and contains silicon; and a liquid-repellent film which is provided on the underlayer film and is made of a silane coupling agent having a fluorocarbon group. The liquid-repellent member is characterized in that a intensity ratio of ions highest detected in fluorocarbon-based fragment ions to silicon ions is greater than or equal to 10, when the fluorocarbon-based fragment ions and the silicon ions are detected through measurement by a Time-of-Flight Secondary Ion Mass Spectrometer.

In the first aspect, the intensity ratio of ions highest detected in fluorocarbon-based fragment ions to silicon ions is grater than or equal to 10, when the fluorocarbon-based fragment ions and the silicon ions are detected by the Time-of-Flight Secondary Ion Mass Spectrometer (hereinafter referred to appropriately as "ToF-SIMS"). With this configuration, the liquid-repellent member has high liquid repellency, is excellent in liquid-repellent durability, and can thus maintain the liquid repellency over a long time period.

In a second aspect of the invention according to the first aspect, the liquid-repellent member is characterized in that the intensity ratio of the ions highest detected in the fluorocarbon-based fragment ions to the silicon ions is greater than or equal to 20.

In the second aspect, the intensity ratio of the ions highest detected in the fluorocarbon-based fragment ions to the silicon ions is greater than or equal to 20. Therefore, it is possible to reliably provide the liquid-repellent member having high liquid repellency and liquid-repellent durability.

In a third aspect of the present invention according to any one of the first and the second aspects, the liquid-repellent member is characterized in that the ions highest detected in the fluorocarbon-based fragment ions are $C_xF_{2x+1}^+$ ($1 \leqq x \leqq 11$).

In the third aspect, by setting the $C_xF_{2x+1}^+/Si^+$ ratio to greater than or equal to 10 (where $1 \leqq x \leqq 11$), the liquid-repellent member is excellent in liquid repellency and liquid-repellent durability.

In a fourth aspect of the present invention according to the third aspect, the liquid-repellent member is characterized in that ions highest detected in the fluorocarbon-based fragment ions are $C_2F_5^+$.

In the fourth aspect, by setting the $C_2F_5^+/Si^+$ ratio to greater than or equal to 10, the liquid-repellent member has high liquid repellency and liquid-repellent durability.

In a fifth aspect of the present invention, a nozzle plate is characterized in that the nozzle plate is formed of the liquid-repellent member of any one of the first to the fourth aspects, and the base has nozzle orifices.

In the fifth aspect, by setting the intensity ratio of specific ions detected by the ToF-SIMS to greater than or equal to 10, the nozzle plate is excellent in liquid repellency and liquid-repellent durability.

In a sixth aspect of the present invention, a liquid-jet head includes: a nozzle plate of the fifth aspect; a passage-forming substrate having pressure generating chambers formed therein, the pressure generating chambers communicating correspondingly with the nozzle orifices; and pressure generating means which causes a pressure change in each of the pressure generating chambers and causes the nozzle orifices to jet liquid droplets.

In the sixth aspect, it is possible to provide the liquid-jet head having high print quality such as high resolution and high accuracy, and excellent durability since the nozzle plate is excellent in liquid repellency and liquid-repellent durability because of being configured so that the intensity ratio of specific ions detected by the ToF-SIMS is greater than or equal to 10.

In a seventh aspect of the present invention according to the sixth aspect, a liquid-jet apparatus is characterized by including the liquid-jet head.

In the seventh aspect, it is possible to provide the liquid-jet apparatus having the liquid-jet head, in which characteristics of ejecting liquid droplets are remarkably improved.

DESCRIPTION OF THE PREFERRED EMBODIMENTS

First Embodiment

Figure 1A:
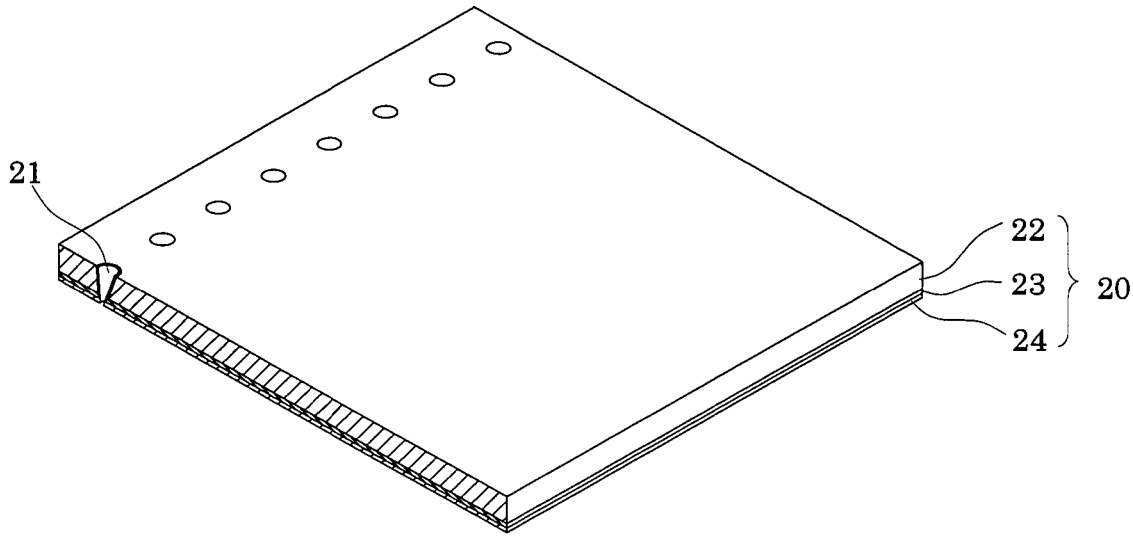
FIGS. 1A and 1B are a perspective view and a sectional view, respectively, of a nozzle plate according to a first embodiment of the present invention.
Figure 1B:
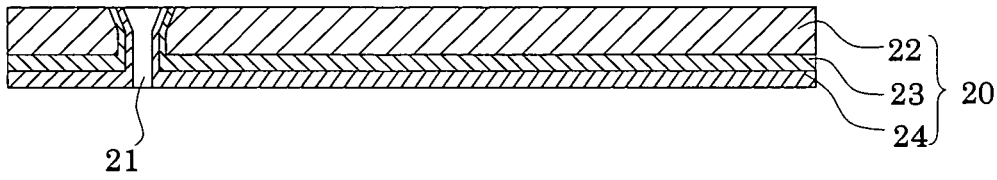

FIGS. 1A and 1B are a perspective view and a sectional view, respectively, of a nozzle plate according to a first embodiment of a liquid-repellent member of the present invention. A nozzle plate for use in a liquid-jet head is taken as an example of the liquid-repellent member of the present invention. As shown in FIG. 1A and FIG. 1B, a nozzle plate 20 includes a base 22 having nozzle orifices 21 formed therein, an underlayer film 23 provided on the surface of the base 22, and a liquid-repellent film 24 provided on the underlayer film 23. The underlayer film 23 and the liquid-repellent film 24 are provided on an outer surface of the base 22 and in the nozzle orifices 21. In FIG. 1B, there are shown the underlayer film 23 and the liquid-repellent film 24 formed so as to extend into the nozzle orifices 21. The underlayer film 23 and the liquid-repellent film 24, however, may be partially or wholly removed according to a purpose of the liquid-jet head. The underlayer film 23 is a film containing silicon, and the liquid-repellent film 24 is a film made of a silane coupling agent having a fluorocarbon group.

In the present invention, the base surface having the underlayer film and liquid-repellent film provided thereon is such that a intensity ratio of ions highest detected in fluorocarbon-based fragment ions to silicon ions (with a mass number of 28), that is, the ions highest detected in fluorocarbon-based fragment ions/silicon ions ratio (i.e., the intensity ratio) is greater than or equal to 10 or preferably 20. In the present invention, a Time-of-Flight Secondary Ion Mass spectrometer (ToF-SIMS) is used to detect the fluorocarbon-based fragment ions and the silicon ions. When the ions highest detected in fluorocarbon-based fragment ions/silicon ions ratio (i.e., the intensity ratio) is greater than or equal to 10 as mentioned above, the liquid-repellent member has good liquid repellency and alkali resistance. More preferably, the ions highest detected in fluorocarbon-based fragment ions/silicon ions ratio (i.e., the intensity ratio) is in a range from 20 to 40.

As employed herein, the ToF-SIMS refers to an apparatus for measuring molecules or the like of the film presented on the topmost surface of the base. Measurement by the ToF-SIMS involves irradiating the surface of a specimen with weak Ga (gallium) pulse ions of about 15 keV, and sputtering the constituents of the surface; accelerating resultant charged ions (i.e., secondary ions) through the application of an electric field; and detecting the secondary ions at a given distance (i.e., a flight distance). Since lighter ions fly at a faster speed while heavier ions fly at a slower speed, by measurement of the time interval between the generation and the detection of the secondary ions (i.e., a time of flight), a mass of the generated secondary ions can be obtained.

Since the ToF-SIMS provides a significantly low level of primary ion irradiation of about 15 keV, an organic compound irradiated with primary ions ejects fragment ions reflecting its structure, therefore the structure of the organic compound present on the surface from a mass spectrum can be known. Moreover, information on the topmost surface of the specimen (e.g., a depth of about a few angstroms) can be obtained because only the secondary ions generated on the outermost surface of the solid specimen surface fly into a vacuum.

The ToF-SIMS mentioned above is used to perform measurement and detection on the liquid-repellent member of the present invention, specifically to measure and detect fluorocarbon-based fragment ions and silicon ions. The fluorocarbon-based fragment ions to be measured and detected include perfluoroalkyl ions, fluoroalkyl ions, in which part of hydrogen of an alkyl group is substituted by fluorine, and perfluoropolyether ions. In the liquid-repellent member of the present invention, the intensity ratio of fluorocarbon-based fragment ions highest detected in fluorocarbon-based fragment ions detected to silicon ions is greater than or equal to 10. Preferably, the ions highest detected in the detected-fluorocarbon-based fragment ions are perfluoroalkyl ions ($C_xF_{2x+1}^+(1 \leqq x \leqq 11)$). More preferably, the ions highest detected in the fluorocarbon-based fragment ions are $C_2F_5^+$ (with a mass number of 119), and the $C_2F_5^+/Si^+$ ratio is greater than or equal to 10.

The base constituting the liquid-repellent member of the present invention can be made of any one of a metallic material, a composite material, a resin-based material, or the like. The metallic materials include stainless steel, nickel, and iron. The composite materials include a material containing silicon, sapphire, or carbon. The resin-based materials include polytetrafluoroethylene, polyethylene, polyimide, polyamideimide, poly(phenylene sulfide), polyetheretherketone, polyoxymethylene, polystyrene, acrylonitrile/butadiene/styrene, poly(butylene terephthalate), poly(phenylene ether), a potassium titanate fiber composite resin, polypropylene, an ethylene-propylene-diene terpolymer, an olefin-based elastomer, an urethane-based elastomer, chloroprene rubber, silicone rubber, and butyl rubber. In the first embodiment, stainless steel having two rows of nozzle orifices, each row having 180 orifices per inch, is used as the base. In FIG. 1A, there is shown only one of the rows.

Any film containing silicon can be used as the underlayer film provided on the base. For example, a plasma polymerized film made of a silicone material can be used as the underlayer film. Alternatively, a plasma polymerized film made of $SiO_2$, a film formed by liquid-based film formation method (such as coating, spray, or immersion), a deposited film, a sputtered film, or the like may be used as the underlayer film. The materials of the plasma polymerized film made of the silicone material include silicone oil and alkoxysilane. In the first embodiment, a plasma polymerized film made of silicone is used as the underlayer film.

The liquid-repellent film made of the silane coupling agent having a fluorocarbon group is provided on the underlayer film. The fluorocarbon groups include a perfluoroalkyl group, a fluoroalkyl group in which a part of hydrogen of an alkyl group is substituted by fluorine, and a group consisting of perfluoropolyether. Specific examples of the silane coupling agent having the fluorocarbon group include heptatriacontafluoroicosyltrimethoxysilane. In the first embodiment, a film formed by polymerization of heptatriacontafluoroicosyltrimethoxysilane is used as the liquid-repellent film. In the present invention, the liquid-repellent film, of course, is not limited to being made of heptatriacontafluoroicosyltrimethoxysilane.

A method of forming the underlayer film and the liquid-repellent film on the base is not especially limited. An outline thereof will be described below.

The liquid-repellent member of the present invention can be manufactured through the following processes: a process of cleaning the base; a process of forming the underlayer film; a process of activating the surface of the underlayer film; a process of forming the liquid-repellent film; a process of humidifying and drying; and a process of annealing. The "process of cleaning the base" takes place for a purpose of removing undesired substances which are present on the base and disadvantageous for the formation of the underlayer film on the base, or the like. Detailed cleaning conditions should be appropriately selected according to the material, shape or size of the base, or the like. For the "process of forming the underlayer film," detailed conditions of film formation should be appropriately selected according to the material, shape or size of the base, the type or thickness of the underlayer film, the type of the silane coupling agent to form the liquid-repellent film, or the like. The "process of activating the surface of the underlayer film" takes place in order to provide the underlayer film with an OH group for tightly coupling the liquid-repellent film made of the silane coupling agent having the fluorocarbon group onto the underlayer film. When the liquid-repellent film made of the silane coupling agent is formed on the underlayer film processed in the manner as mentioned above, the OH group of the underlayer film is coupled to the liquid-repellent film made of the silane coupling agent. This results in the liquid-repellent film having high density and high adhesion properties. Specifically, the processes of activation include plasma or ultraviolet irradiation and heat treatment of the surface of the underlayer film. Detailed process conditions should be appropriately selected according to the type or thickness of the underlayer film, the type of the silane coupling agent to form the film, or the like. For the "process of forming the liquid-repellent film," detailed conditions of film formation should be appropriately selected according to the type of the silane coupling agent having the fluorocarbon group, desired liquid repellency, or the like. The "process of humidifying and drying" is performed in a high-temperature and high-humidity atmosphere in order to form the liquid-repellent film by coupling of the silane coupling agent having the fluorocarbon group and the surface of the underlayer film. This coupling is caused by a dehydration and condensation reaction therebetween. Detailed process conditions should be appropriately selected according to the type of the silane coupling agent having the fluorocarbon group, desired liquid repellency, or the like. The "process of annealing" is performed at a higher temperature as compared to the "process of humidifying and drying," in order to terminate a polymerization reaction of the silane coupling agent. Detailed process conditions should be appropriately selected according to the type of the silane coupling agent having the fluorocarbon group, desired liquid repellency, or the like. Incidentally, the types of the underlayer film and liquid-repellent film, the concentration of a solution for use in the "process of forming the liquid-repellent film," temperature conditions for the "process of humidifying and drying," or the like can be adjusted so that the ions highest detected in fluorocarbon-base fragment ions/silicon ions ratio (i.e., the intensity ratio), which is obtained through detection by the ToF-SIMS, is grater than or equal to 10.

The first embodiment will now be described in further detail, based on test examples.

TEST EXAMPLE 1

ToF-SIMS-Based Measurement

Figure 2:
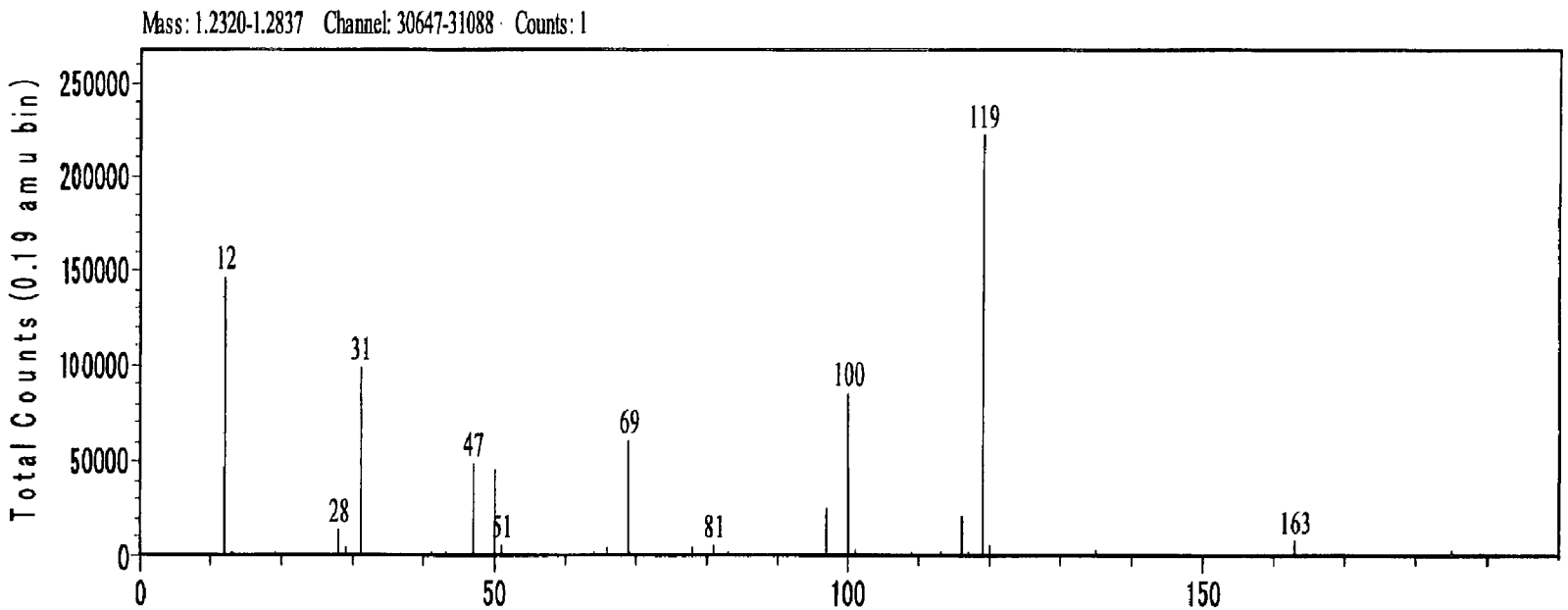
FIG. 2 is a graph showing a ToF-SIMS analytical spectrum of a liquid-repellent member of a test example 1.

Three types of nozzle plates A to C were made under varying conditions of film formation for the silane coupling agent to form the film in the process of forming the liquid-repellent film. Each of the nozzle plates A to C includes a base made of stainless steel having nozzle orifices (e.g., two rows of nozzle orifices, each row having 180 orifices per inch), an underlayer film made of a plasma polymerized film made of dimethyl polysiloxane, and a liquid-repellent film made of a film formed by polymerization of heptatriacontafluoroicosyltrimethoxysilane. Each nozzle plate was soaked for 30 minutes in Lunox MA-23L (which is the trade name for an alkaline cleaning solution commercially available from TOHO Chemical Industry Co., LTD.). Then, the ToF-SIMS was used to make measurements on each nozzle plate under conditions given below. Incidentally, before and after soaking in the alkaline cleaning solution, the measured values obtained by the ToF-SIMS did not exhibit such variations which might affect the functions and effects of the present invention. The results of measurements are as follows. In the nozzle plates A to C, a peak of $C_2F_5^+$ (with a mass number of 119) was highest detected, and a peak of silicon ions (with a mass number of 28) was also detected. In the nozzle plates B and C, the $C_2F_5^+/Si^+$ ratio (i.e., the intensity ratio) was grater than or equal to 10. As for the nozzle plate C, an analytical spectrum obtained by the ToF-SIMS is shown in FIG. 2.

Conditions of measurement for ToF-SIMS

Measurement-equipment: TRIFT II (ULVAC-PHI, Inc.)

Irradiation ion: 15 keV, $^{69}Ga^+$ ion

Irradiation dose: about $5E^{12}/cm^2$

TEST EXAMPLE 2

Alkali Resistance Test

Figure 3:
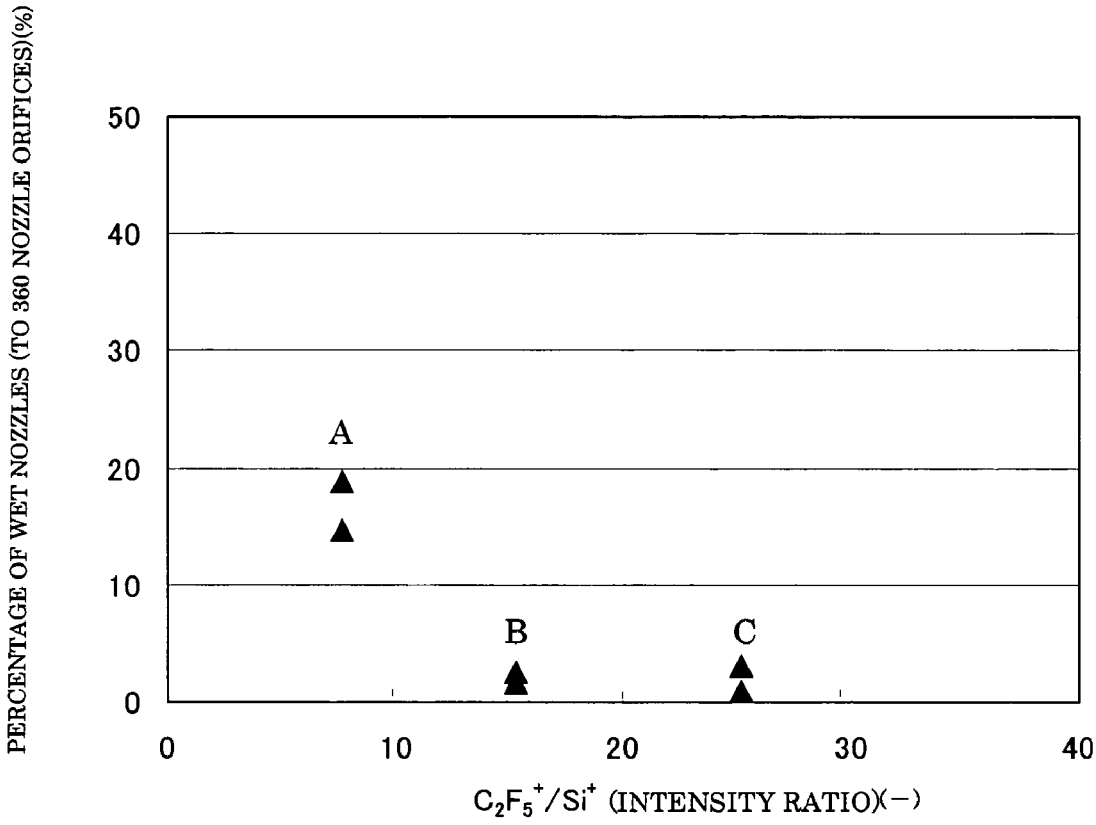
FIG. 3 is a graph showing the test results of a test example 2.

Moreover, each of the nozzle plates A to C was soaked for 30 minutes in Lunox MA-23L (which is the trade name for the alkaline cleaning solution commercially available from TOHO Chemical Industry Co., LTD.). Then, each nozzle plate was subjected to wiping. Specifically, each nozzle plate, with its surface splashed with ink, was wiped 200 times by a head cleaning wiper. The percentage of nozzles wetted with the ink was determined. Each of the nozzle plates A to C underwent the same test twice. In FIG. 3, there is shown a plot of the $C_2F_5^+/Si^+$ ratio obtained by the ToF-SIMS.

As shown in FIG. 3, the nozzle plates B and C of the present invention having a $C_2F_5^+/Si^+$ ratio exceeding 10 had a low percentage of wet nozzles. On the other hand, the nozzle plate A having a $C_2F_5^+/Si^+$ ratio of about 8 had a high percentage of wet nozzles. It was therefore confirmed that the higher $C_2F_5^+/Si^+$ ratio was, the higher wetting resistance of the nozzle was, and the nozzles were hardly wetted.

TEST EXAMPLE 3

Four types of nozzle plates D to G were made. Each of the nozzle plates D to G includes a base made of stainless steel having nozzle orifices (e.g., two rows of nozzle orifices, each row having 180 orifices per inch), an underlayer film made of a plasma polymerized film made of dimethyl polysiloxane, and a liquid-repellent film made of a film formed by polymerization of heptatriacontafluoroicosyltrimethoxysilane. The ToF-SIMS was used to make measurements on the surface of each nozzle plate under the same conditions as in the case of the test example 1. The results of measurements are as follows. In the nozzle plates D to G, a peak of $C_2F_5^+$ (with a mass number of 119) was highest detected, and a peak of silicon ions (with amass number of 28) was also detected.

Moreover, each of the nozzle plates D to G was soaked in the alkalis of the above-mentioned Lunox MA-23L for 30 minutes. Thereafter, the surface of each nozzle plate was traced by a roll-shaped BEMCOT (product of ASAHI KASEI FIBERS CORPORATION). The tip of the BEMCOT was impregnated with a sufficient amount of ink to be absorbed. An ink settling time was measured. As employed herein, the ink settling time refers to the time which elapses until the ink converges and stops moving due to its surface tension. The results of measurements are shown in Table 1 and FIG. 4. An approximate equation is also shown in conjunction with the results in FIG. 4.

Figure 4:
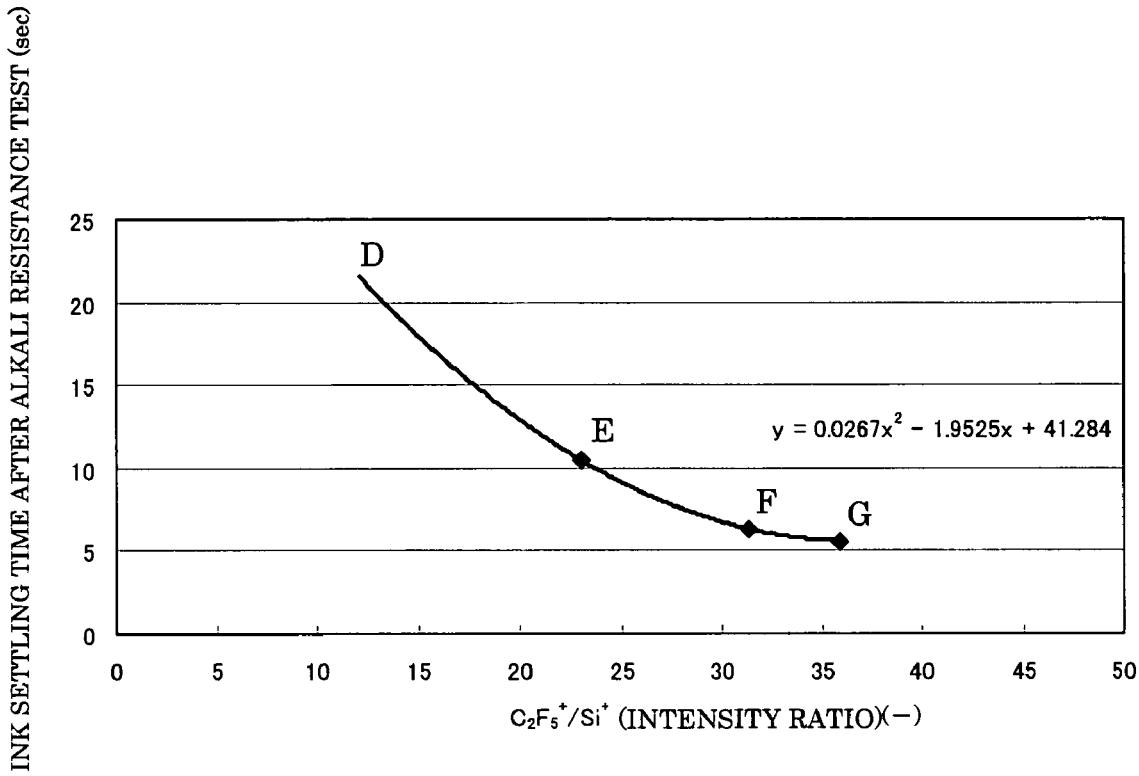
FIG. 4 is a graph showing the test results of a test example 3.

As shown in Table 1 and FIG. 4, the nozzle plates D to G having a $C_2F_5^+/Si^+$ ratio greater or equal to 10 had a short ink settling time and very high liquid repellency on their respective surfaces. It was also confirmed that the higher the $C_2F_5^+/Si^+$ ratio was, the shorter ink settling time was. Incidentally, there was no distinct difference among contact angles of the nozzle plates D to G with respect to water.

TABLE 1

| | $C_2F_5^+/Si^+$ (Intensity ratio) | Ink settling time (sec) |
|---|---|---|
| Liquid-repellent member D | 12.1 | — |
| Liquid-repellent member E | 23 | 10.5 |
| Liquid-repellent member F | 31.4 | 6.3 |
| Liquid-repellent member G | 35.9 | 5.6 |

As described above, the liquid-repellent member having ions highest detected in fluorocarbon-based fragment ions/silicon ions ratio greater than or equal to 10 is excellent in liquid repellency and liquid-repellent durability. The ToF-SIMS can obtain information derived from the liquid-repellent film in itself unlike the case of the contact angle or the like. Simultaneously, the TOF-SIMS can also distinguish and detect the presence or absence of other influences such as contamination or the like. Thus, an approach with little error and high accuracy can be adopted to manufacture the liquid-repellent member. Moreover, the intensity ratio between ions highest detected in fluorocarbon-based fragment ions and silicon ions, obtained by the ToF-SIMS analyzing the surface of the liquid-repellent member, can be used for evaluation of the liquid repellency of the liquid-repellent member. For example, by managing a manufacturing process in order that the $C_2F_5^+/Si^+$ ratio always achieves a constant level of intensity, a nozzle head having high quality with stability can be manufactured.

In the first embodiment, the nozzle plate is given as the example of the liquid-repellent member. However, the liquid-repellent member of the present invention is not limited to this embodiment but may be applied to a product whose surface requires liquid repellency. For example, the liquid-repellent member of the present invention may be applied to system structural members (made of a resin-based or composite material) of a liquid-jet apparatus other than the nozzle plate, such as a head cap, a head cleaning wiper, a holding lever of the wiper for head cleaning, a gear, a platen, or a carriage. Alternatively, the liquid-repellent member of the invention may be applied to a member requiring liquid repellency, besides the system structural members of the liquid liquid-jet apparatus.

Second Embodiment

Figure 5:
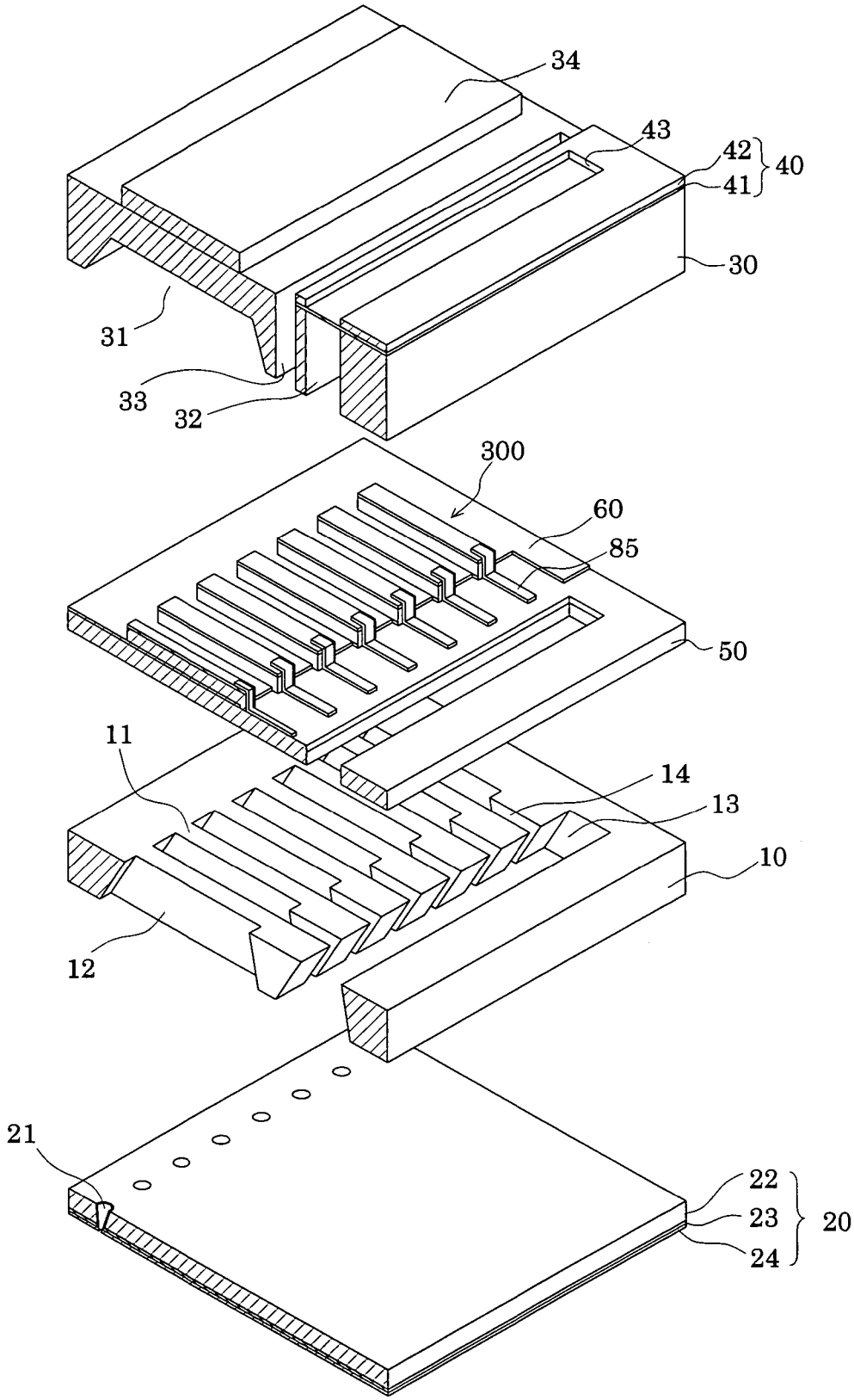
FIG. 5 is an exploded perspective view of a liquid-jet head according to a second embodiment of the present invention.
Figure 6A:
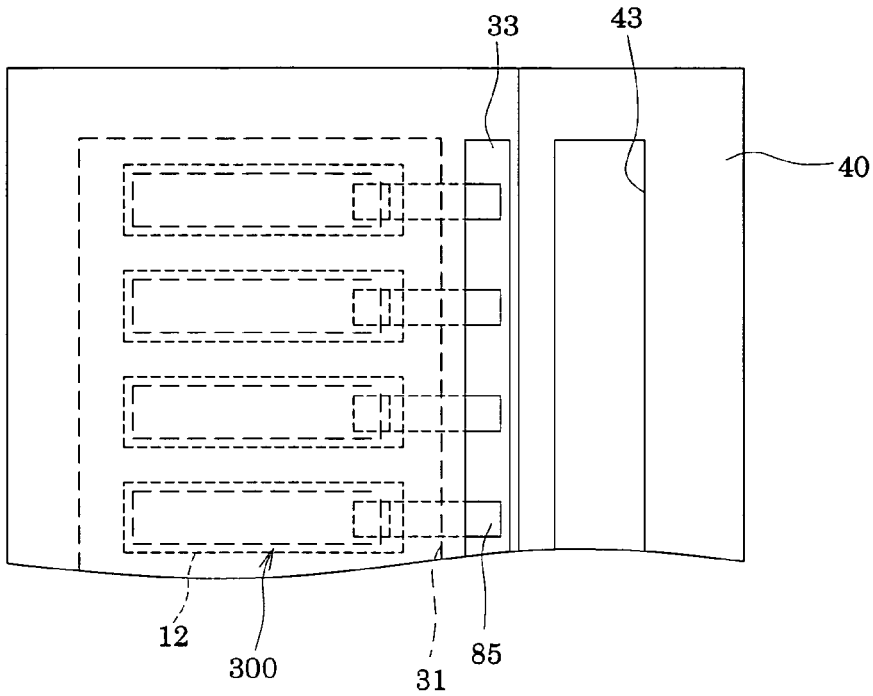
FIGS. 6A and 6B are a plan view and a sectional view, respectively, of the liquid-jet head according to the second embodiment of the invention.
Figure 6B:
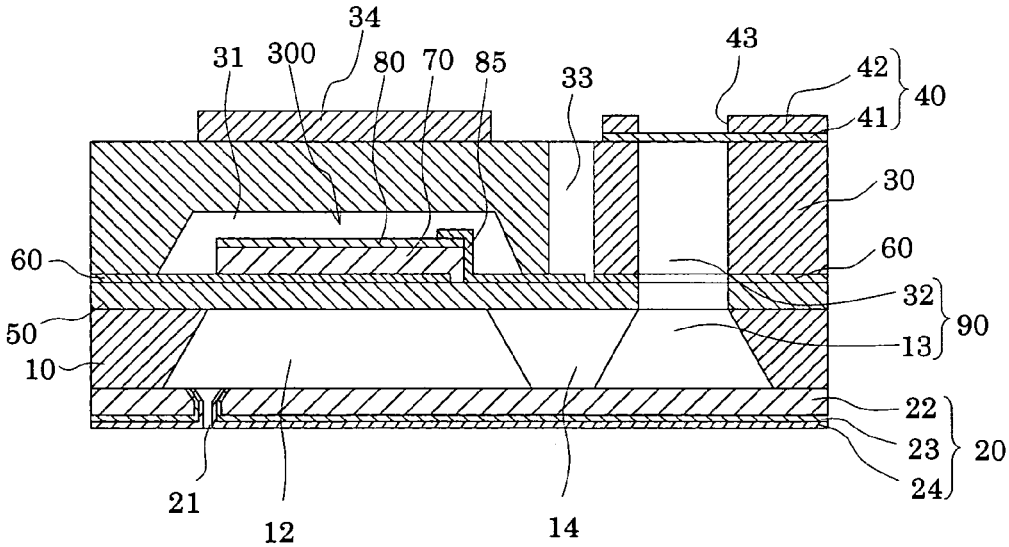

FIG. 5 is an exploded perspective view showing the general configuration of a liquid-jet head according to the present invention. FIGS. 6A and 6B are a plan view and a sectional view, respectively, of the liquid-jet head shown in FIG. 5.

In a second embodiment, as shown in FIGS. 5 to 6B, a passage-forming substrate 10 is made of a plane oriented (110) single crystal silicon substrate. An elastic film 50 with a thickness of 0.5 to 2 μm, made of silicon dioxide, is formed on one surface of the passage-forming substrate 10. In the second embodiment, the elastic film 50 is an amorphous (or non-crystalline) film made of silicon oxide formed by thermal oxidation of the passage-forming substrate 10 made of the single crystal silicon substrate. The elastic film 50 has a surface in a flat state, keeping the surface state of the passage-forming substrate 10 as it is.

In the passage-forming substrate 10, a plurality of pressure generating chambers 12 partitioned by a plurality of compartment walls 11 are arranged in parallel in a width direction through anisotropic etching of the single crystal silicon substrate on one surface thereof. A communicating portion 13, which communicates with a reservoir portion 32 of a protective plate 30 to be described later, is formed longitudinally external to the pressure generating chambers 12. The communicating portion 13 communicates with one longitudinal end of each pressure generating chamber 12 through its corresponding ink supply path 14. The ink supply path 14 communicating with one end of the pressure generating chamber 12 is formed in a narrower width than that of the pressure generating chamber 12, and keeps constant the passage resistance of ink flowing into the pressure generating chamber 12.

Preferably, the passage-forming substrate 10 having the pressure generating chambers 12 and others formed therein has an optimum thickness selected according to a density at which the pressure generating chambers 12 are arranged. For example when the pressure generating chambers 12 are arranged in a way that about 180 chambers are arranged per inch (that is, at a density of about 180 dpi), the passage-forming substrate 10 has a thickness of preferably about 180 to 280 μm, or more preferably about 220 μm. For example when the pressure generating chambers 12 are arranged at a relatively high density of about 360 dpi, the passage-forming substrate 10 preferably has a thickness of 100 μm or less, because this configuration enables a high-density arrangement, while keeping a stiffness of the compartment wall 11 between the adjacent pressure generating chambers 12.

The nozzle plate 20 according to the first embodiment is fixedly bonded to an orifice surface of the passage-forming substrate 10 with an adhesive agent, a thermal adhesive film or the like in between. The nozzle plate 20 has the nozzle orifices 21 formed therein, and the nozzle orifices 21 communicate correspondingly with the pressure-generating chambers 12 on the sides thereof opposite to the ink supply paths 14. As mentioned above, the nozzle plate 20 includes the base 22, the underlayer film 23 provided on the base 22, and the liquid-repellent film 24 provided on the underlayer film 23 on the base 22. The nozzle plate 20 is configured so that the intensity ratio of specific ions detected by the ToF-SIMS is greater than or equal to 10. Thus, the nozzle plate 20 is excellent in liquid repellency and durability. Therefore, the use of the nozzle plate 20 enables realizing the liquid-jet head of the second embodiment having high print quality, such as high resolution and high accuracy, and excellent durability.

A lower electrode film 60 of, for example, about 0.2 μm thick, a piezoelectric layer 70 of, for example, about 1 μm thick, and an upper electrode film 80 of, for example, about 0.05 μm thick are formed on the elastic film 50 on the surface, opposite the orifice surface, of the passage-forming substrate 10. The lower electrode film 60, the piezoelectric layer 70 and the upper electrode film 80 are laminated through a process to be described later, and constitute a piezoelectric element 300. As employed herein, the piezoelectric element 300 refers to a portion including the lower electrode film 60, the piezoelectric layer 70 and the upper electrode film 80. Generally, one of the upper and lower electrodes of the piezoelectric element 300 is used as a common electrode, and the other electrode and the piezoelectric layer 70 are patterned for each of the pressure generating chambers 12. There is a portion including the patterned electrode and the patterned piezoelectric layer 70, in which piezoelectric strain occurs due to application of a voltage to both the electrodes. This portion is herein called a "piezoelectric active portion." In the second embodiment, the lower electrode film 60 is used as a common electrode for the piezoelectric elements 300, and the upper electrode films 80 are used as the respective individual electrodes of the piezoelectric elements 300. However, no problem arises even if the roles of the upper and lower electrodes are exchanged with each other for convenience of a drive circuit or interconnections. In either of these cases, the piezoelectric active portion is formed for each of the pressure generating chambers 12. A combination of the piezoelectric element 300 and a vibration plate, in which a displacement occurs by a drive of the piezoelectric element 300, is herein called a "piezoelectric actuator."

Incidentally, a lead electrode 85 made of, for example, gold (Au) or the like is connected to the upper electrode film 80 of each piezoelectric element 300. The lead electrode 85 is drawn out from the vicinity of the longitudinal end of each piezoelectric element 300 and extends to the top of the elastic film 50 in a region corresponding to the ink supply path 14. The lead electrode 85 is electrically connected to a drive IC (integrated circuit) 34, as will be described in detail later.

The lower electrode film 60 described above can be made of a metal selected from a group consisting of platinum-group metals, such as iridium (Ir), platinum (Pt), and palladium (Pd), and gold (Au), and have a laminated structure including a plurality of layers. When the plurality of layers are laminated, a process after the laminating process may result in a mixed layer. In the second embodiment, a Pt layer, an Ir layer and a Pt layer are laminated in this sequence as viewed from the elastic film 50, to thus form a laminated film.

Preferably, the piezoelectric layer 70 provided on the lower electrode film 60 has an orientation of crystals. In the second embodiment, a so-called sol-gel process, for example, is used to form the piezoelectric layer 70 having an orientation of crystals. Specifically, the process involves dissolving and dispersing a metal-organic substance in a catalytic agent to form so-called sol; applying and drying the sol, and allowing the sol to be gelled; and baking the resultant gel at a high temperature. Therefore, the piezoelectric layer 70 made of metal oxide can be obtained. Preferably, a lead-zirconate-titanate-based material is used as a material of the piezoelectric layer 70 when it is used in an inkjet recording head. A method of forming the piezoelectric layer 70 is not particularly limited. For example, the sputtering method may be used to form the piezoelectric layer 70. Alternatively, the following approach may be adopted to form the piezoelectric layer 70. The approach involves forming a lead-zirconate-titanate precursor film by means of the sol-gel process, the sputtering method, or the like; and then subjecting the precursor film to high-pressure process in an alkaline aqueous solution to grow crystals at a low temperature.

In any of these instances, the piezoelectric layer 70 formed in the manner as mentioned above has a priority orientation of crystals, unlike a bulk piezoelectric element. In the second embodiment, the piezoelectric layer 70 also has columnar crystals formed therein. Incidentally, the priority orientation refers to a state in which crystals are not irregularly oriented but are oriented with their given crystal faces oriented in substantially a uniform direction. The thin film having the columnar crystals refers to a thin film formed of crystals in substantially a cylindrical shape, which converge all along a plane with their central axes substantially coinciding with a thickness direction. The thin film, of course, may be formed of granular crystals of a priority orientation. Generally, the piezoelectric layer manufactured by a thin film process as mentioned above has a thickness of 0.2 to 5 μm.

The protective plate 30 is bonded to the passage-forming substrate 10, facing the piezoelectric elements 300. The protective plate 30 has a piezoelectric element holding portion 31 securing a space large enough not to hinder the piezoelectric elements 300 from moving. The piezoelectric elements 300 are formed within the piezoelectric element holding portion 31.

The protective plate 30 is provided with the reservoir portion 32 constituting at least a part of a reservoir 90, which is a common ink chamber for the pressure generating chambers 12. As mentioned above, the reservoir portion 32 communicates with the communicating portion 13 of the passage-forming substrate 10, and thus constitutes the reservoir 90 which is the common ink chamber for the pressure generating chambers 12.

A connection hole 33 is provided between the piezoelectric element holding portion 31 and the reservoir portion 32 of the protective plate 30, that is, in a region corresponding to the ink supply path 14. The connection hole 33 penetrates the protective plate 30 in a thickness direction. The drive IC 34 for driving the piezoelectric elements 300 is mounted on the surface, opposite the piezoelectric element holding portion 31, of the protective plate 30. The lead electrode 85 drawn out from each piezoelectric element 300 extends to the connection hole 33 and is connected to the drive IC 34 by means of wire bonding or the like, for example.

A compliance plate 40 is bonded onto the protective plate 30. The compliance plate 40 is formed of a sealing film 41 and a fixed plate 42. The sealing film 41 is made of a flexible material with a low rigidity (for example, a polyphenylene sulfide (PPS) film with a thickness of 6 μm). The fixed plate 42 is made of a hard material such as metal (for example, stainless steel (SUS) with a thickness of 30 μm, or the like). An opening portion 43 is formed in a region, opposite the reservoir 90, of the fixed plate 42. The opening portion 43 is formed by completely removing a portion corresponding to this region from the fixed plate 42 in the thickness direction. One end of the reservoir 90 is sealed up only by the flexible sealing film 41.

The liquid-jet head takes in ink from external ink supply means, which is not shown, and fills the interior ranging from the reservoir 90 through the nozzle orifices 21 with ink. Thereafter, the liquid-jet head applies a voltage between the lower electrode film 60 and the upper electrode films 80 which correspond to the pressure generating chambers 12, in accordance with recording signals from the drive IC 34. Thus, the liquid-jet head distorts the elastic film 50, the lower electrode films 60 and the piezoelectric layers 70 with flexure. This distortion raises a pressure in each of the pressure generating chambers 12, and thereby ink droplets are ejected from the nozzle orifices 21.

Other Embodiments

Although the embodiments of the present invention have been described above, the configuration of the present invention is not limited to the above-mentioned configuration.

In the second embodiment, a thin-film liquid-jet head manufactured by applications of deposition and lithography process is given as an example. However, the invention is not limited to this type of liquid-jet head but may be adopted for, for example, a thick-film liquid-jet head formed by the technique of adhering a green sheet or other techniques. It goes without saying that the invention is not limited to the above-mentioned liquid-jet head of piezoelectric vibration type but may be applied to liquid-jet heads having various structures, such as a liquid-jet head using a heater element. As mentioned above, the present invention can be applied to liquid-jet heads having various structures as long as the variations do not depart from the spirit and scope of the present invention.

Figure 7:
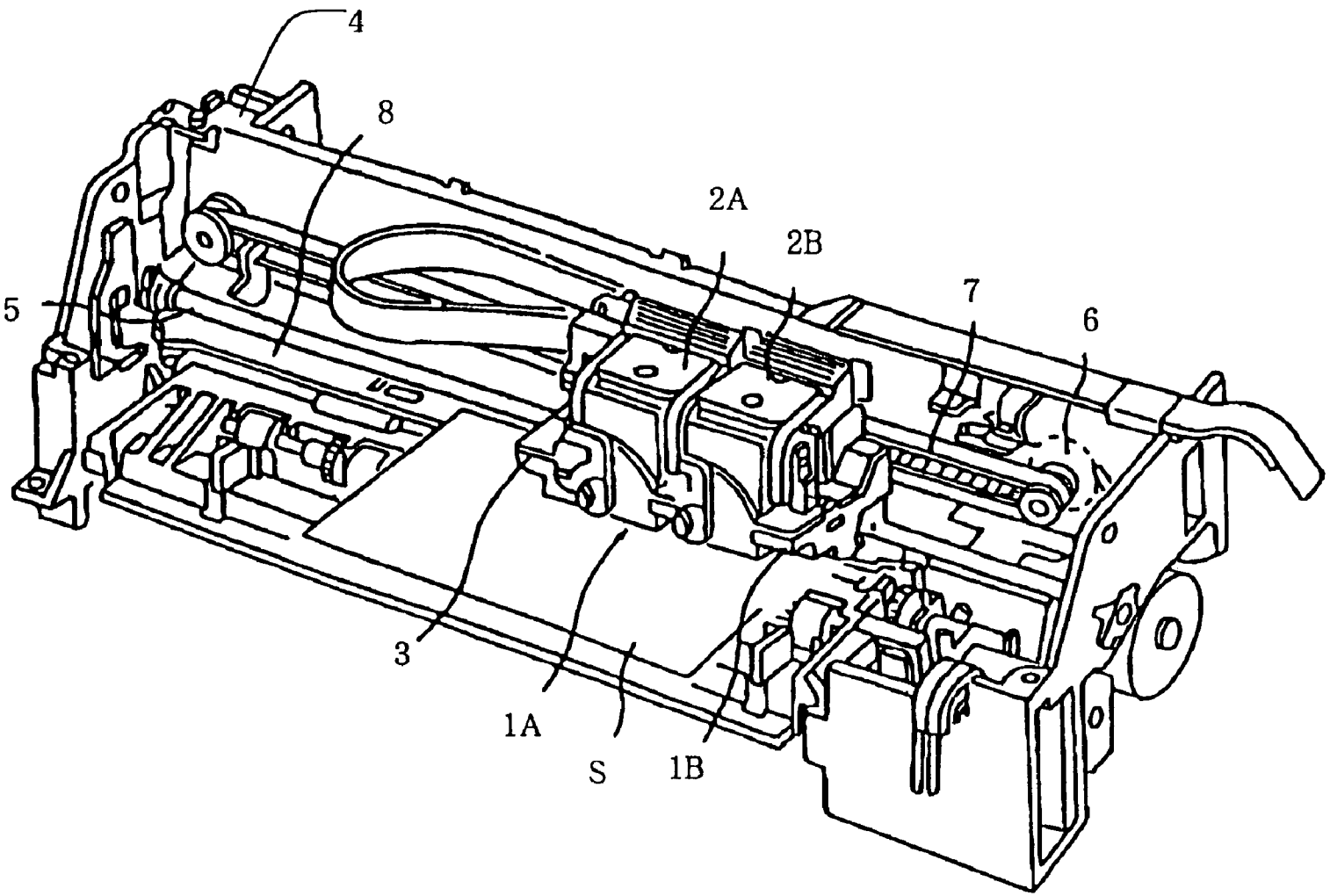
FIG. 7 is a schematic perspective view of an inkjet recording apparatus according to an embodiment of the present invention.

Moreover, the liquid-jet head of the present invention constitutes a part of a recording head unit including an ink passage communicating with an ink cartridge and the like, and is mounted in a liquid-jet apparatus. FIG. 7 is a schematic perspective view showing an example of the liquid-jet apparatus.

As shown in FIG. 7, recording head units 1A and 1B, each having the liquid-jet head, are provided with cartridges 2A and 2B constituting ink supply means, which are detachably attached to the recording head units 1A and 1B, respectively. A carriage 3, in which the recording head units 1A and 1B are mounted, is provided to a carriage shaft 5 fixed to the apparatus body 4 in such a way that the carriage 3 can freely move along the shaft. For example, the recording head units 1A and 1B are designed to eject black ink compositions and color ink compositions, respectively. Incidentally, the number of recording head units and the number of cartridges are not limited to the example shown in FIG. 7.

When a driving force from a drive motor 6 is transmitted to the carriage 3 via a plurality of gears, which are not shown, and a timing belt 7, the carriage 3, in which the recording head units 1A and 1B are mounted, moves along the carriage shaft 5. In the apparatus body 4, a platen 8 is provided along the carriage shaft 5. A recording sheet S, which is a recording medium such as a sheet of paper, is fed and transported onto the platen 8 by a feed roller, which is not shown.

Although the second embodiment has been described by giving the inkjet recording head as an example of the liquid-jet head of the present invention, the basic configuration of the liquid-jet head is not limited to the above-mentioned configuration. The present invention is intended for wide application to the entire range of liquid-jet heads. For example, the present invention may be applied to various types of recording heads for use in an image recording apparatus such as a printer, a color-material-jet head for use in manufacture of a color filter of a liquid crystal display or the like, an electrode-material-jet head for use in formation of an electrode of an organic EL display, an FED (Field Emission Display) or the like, a bio-organic-substance-jet head for use in manufacture of a bio-chip, or the like.

What is claimed is:

1. A liquid-repellent member, comprising:

an underlayer film which is provided on a surface of a base and contains silicon; and a liquid-repellent film which is provided on the underlayer film and is made of a silane coupling agent having a fluorocarbon group, wherein a intensity ratio of ions highest detected in fluorocarbon-based fragment ions to silicon ions is greater than or equal to 10, when the fluorocarbon-based fragment ions and the silicon ions are detected through measurement by a Time-of-Flight Secondary Ion Mass Spectrometer.

2. A liquid-repellent member according to claim 1, wherein the intensity ratio of ions highest detected in the fluorocarbon-based fragment ions to the silicon ions is greater than or equal to 20.

3. A liquid-repellent member according to claim 1, wherein ions highest detected in the fluorocarbon-based fragment ions are $C_xF_{2x+1}^+(1 \leqq x \leqq 11)$.

4. A liquid-repellent member according to claim 3, wherein ions highest detected in the fluorocarbon-based fragment ions are $C_2F_5^+$.

5. A nozzle plate formed of the liquid-repellent member according to claim 1, wherein the base has nozzle orifices.

6. A liquid-jet head, comprising:

the nozzle plate according to claim 5;

a passage-forming substrate having pressure generating chambers formed therein, the pressure generating chambers communicating correspondingly with the nozzle orifices; and pressure generating means which produces a pressure change in each of the pressure generating chambers and causes the nozzle orifices to eject liquid droplets.

7. A liquid-jet apparatus comprising the liquid-jet head according to claim 6.

* * * * *